US005518470A

United States Patent [19]

Piaget et al.

[11] Patent Number: 5,518,470

[45] Date of Patent: May 21, 1996

[54] AEROBIC EXERCISE APPARATUS WITH PIVOTING FOOT TREADLES AND HANDLEBAR

[76] Inventors: Gary D. Piaget, 3390 American Saddler Dr.; Trace O. Gordon, 3880 W. Lariat Rd., both of Park City, Utah 84060

[21] Appl. No.: 515,526

[22] Filed: Aug. 15, 1995

[51] Int. Cl.[6] ..... A63B 21/00

[52] U.S. Cl. ..... 482/51; 482/53; 482/57; 482/62

[58] Field of Search ..... 482/51, 52, 53, 482/57, 62, 79, 80, 37

[56] References Cited

U.S. PATENT DOCUMENTS

| | | | |
|---|---|---|---|
| 2,544,106 | 10/1948 | Ray . | |
| 2,829,891 | 6/1955 | Ludwig . | |
| 2,906,532 | 2/1957 | Echols . | |
| 3,475,020 | 8/1966 | Schauerte . | |
| 3,511,500 | 5/1970 | Dunn . | |
| 3,713,653 | 1/1973 | Romans . | |
| 3,792,860 | 2/1974 | Selnes . | |
| 3,814,420 | 6/1974 | Encke . | |
| 3,833,215 | 9/1974 | Isdith . | |
| 4,376,532 | 3/1983 | Hunstad . | |
| 4,396,189 | 8/1983 | Jenkins . | |
| 4,509,742 | 4/1985 | Cones . | |
| 4,563,001 | 1/1986 | Terands | 482/53 |
| 4,830,362 | 5/1989 | Bull | 482/53 |
| 4,989,858 | 2/1991 | Young et al. | 482/53 |
| 5,178,596 | 1/1993 | McIntire . | |

*Primary Examiner*—Stephen R. Crow
*Attorney, Agent, or Firm*—Salter & Michaelson

[57] ABSTRACT

An exercise device consists of a frame having an upright support member, upper and lower pivot levers pivotably mounted on the support member, first and second foot platforms pivotably mounted on the first and second end portions of the lower pivot lever, hand grips mounted on the first and second end portions of the upper pivot lever, and a resistance cylinder connected between the corresponding first end portions of the upper and lower pivot levers. The upright support is vertically adjustable to adjust the vertical height of the upper pivot lever. In use, the operator stands on the foot platforms, grasps the hand grips of the upper pivot lever, and reciprocates the feet and hands in a rocking, or see-saw type motion similar bicycling, rock climbing or stair climbing. The resistance cylinder comprises a hydraulic-type cylinder which provides resistance during reciprocating movement of the upper and lower pivot levers. In a second embodiment, separate resistance cylinders are respectively attached between the lower pivot lever and the frame, and between the upper pivot lever and the frame. The separate resistance cylinders provide independent adjustment of resistance for both the upper and lower body. By maintaining one of the upper or lower pivot levers in stationary position, the user can independently operate the other lever for an isolated upper or lower body workout.

5 Claims, 5 Drawing Sheets

AEROBIC EXERCISE APPARATUS WITH PIVOTING FOOT TREADLES AND HANDLEBAR

BACKGROUND AND SUMMARY OF THE INVENTION

The instant invention relates to aerobic and muscle toning exercise apparatus, and more particularly to an exercise apparatus including pivoting foot treadles and a pivoting handlebar which simulates the combined actions of bicycling, rock climbing, and stair climbing.

Rocking-type exercise devices have heretofore been known in the art. In this connection, the U.S. Pat. to Dunn No. 3,511,500 represents the closest prior art to the subject invention of which the applicant is aware. The patent to Dunn discloses a see-saw type, or rocking-type exercise device comprising a central pivot lever and two foot treadles mounted on the ends of the pivot lever. The user stands on the treadles and rocks back and forth so that the foot treadles move up and down. A friction device, biased by means of a spring, provides constant friction against rotation of the pivot lever to provide resistance. The device further provides hand-held ropes for the user to grasp while using the device. While the Dunn device functions satisfactorily for its intended purpose, it has been found that a lack of a rigid upper body support means causes the device to be awkward to use, and hence it has not achieved widespread acceptance in the exercise field.

The instant invention provides an exercise device comprising a frame having an upright support member, upper and lower pivot levers pivotably mounted on the support member, first and second foot platforms pivotably mounted on the first and second end portions of the lower pivot lever, hand grips mounted on the first and second ends portions of the upper pivot lever, and a resistance cylinder connected between the corresponding first end portions of the upper and lower pivot levers. In use, the operator stands on the foot platforms, grasps the hand grips of the upper pivot lever, and reciprocates the feet and hands in a rocking, or see-saw type motion. The resistance cylinder comprises a hydraulic-type cylinder which provides resistance during reciprocating movement of the upper and lower pivot levers. The support member is vertically adjustable to position the upper pivot lever above the user's head if desired. The device preferably includes an adjustment means for adjusting the level of resistance provided. The interconnected upper and lower pivot levers make the device extremely stable during use, and thus easier and more comfortable to operate than the prior art device. In a second embodiment, separate resistance cylinders are respectively attached between the lower pivot lever and the frame, and between the upper pivot lever and the frame. The separate resistance cylinders provide independent adjustment of resistance for both the upper and lower pivot levers.

Accordingly, among the objects of the instant invention are: the provision of an exercise device which simulates the combined actions of bicycling, rock climbing, and stair climbing; the provision of a rocking-type exercise apparatus which includes resistance means for providing constant resistance to movement; the provision of exercise apparatus including separate resistance means for independent adjustment of resistance for the upper and lower body; the provision of an exercise device which is stable and easy to operate; and the provision of an exercise device which is inexpensive to manufacture and market.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
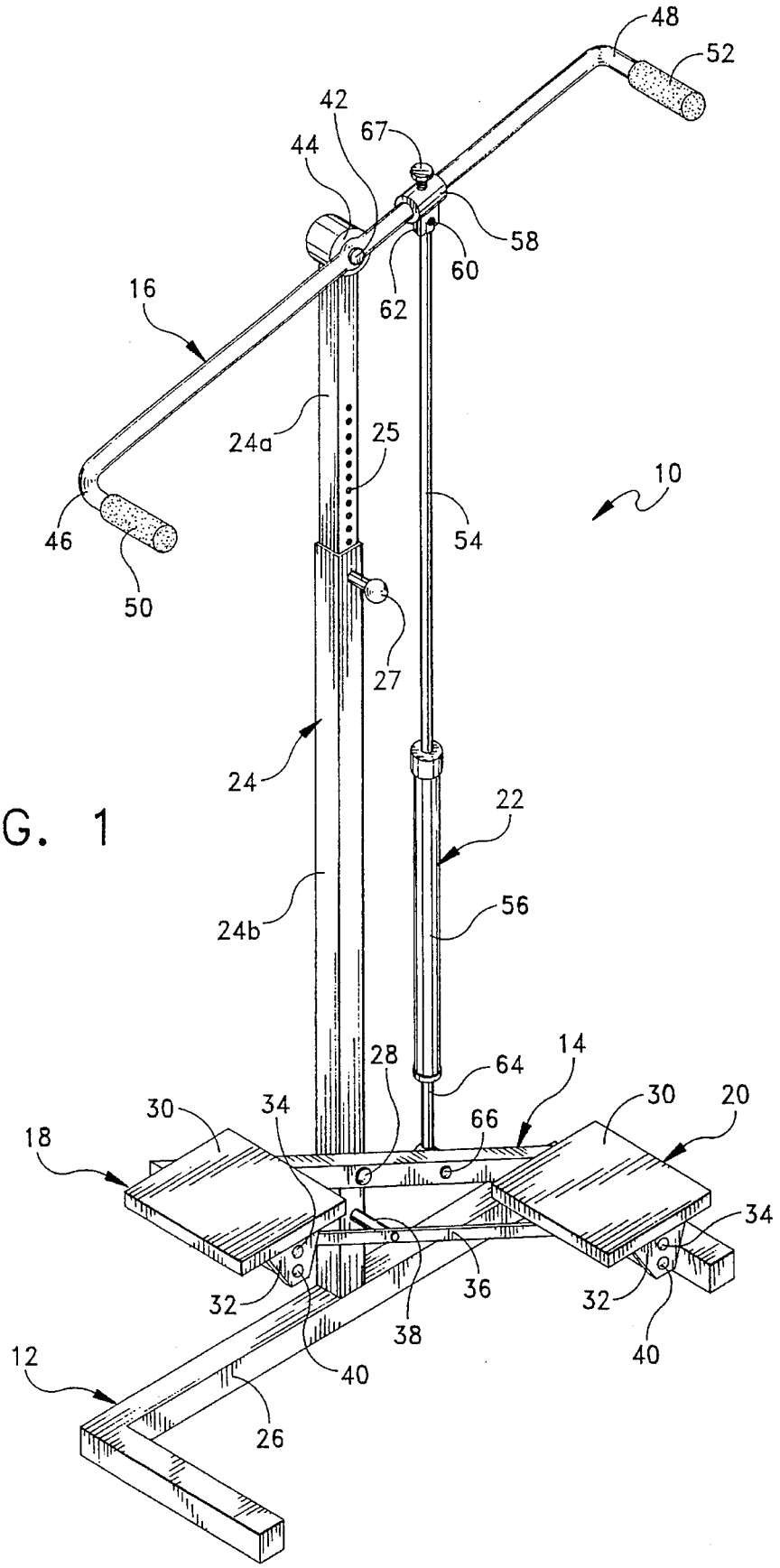
FIG. 1 is a perspective view of the exercise device of the instant invention.
Figure 2:
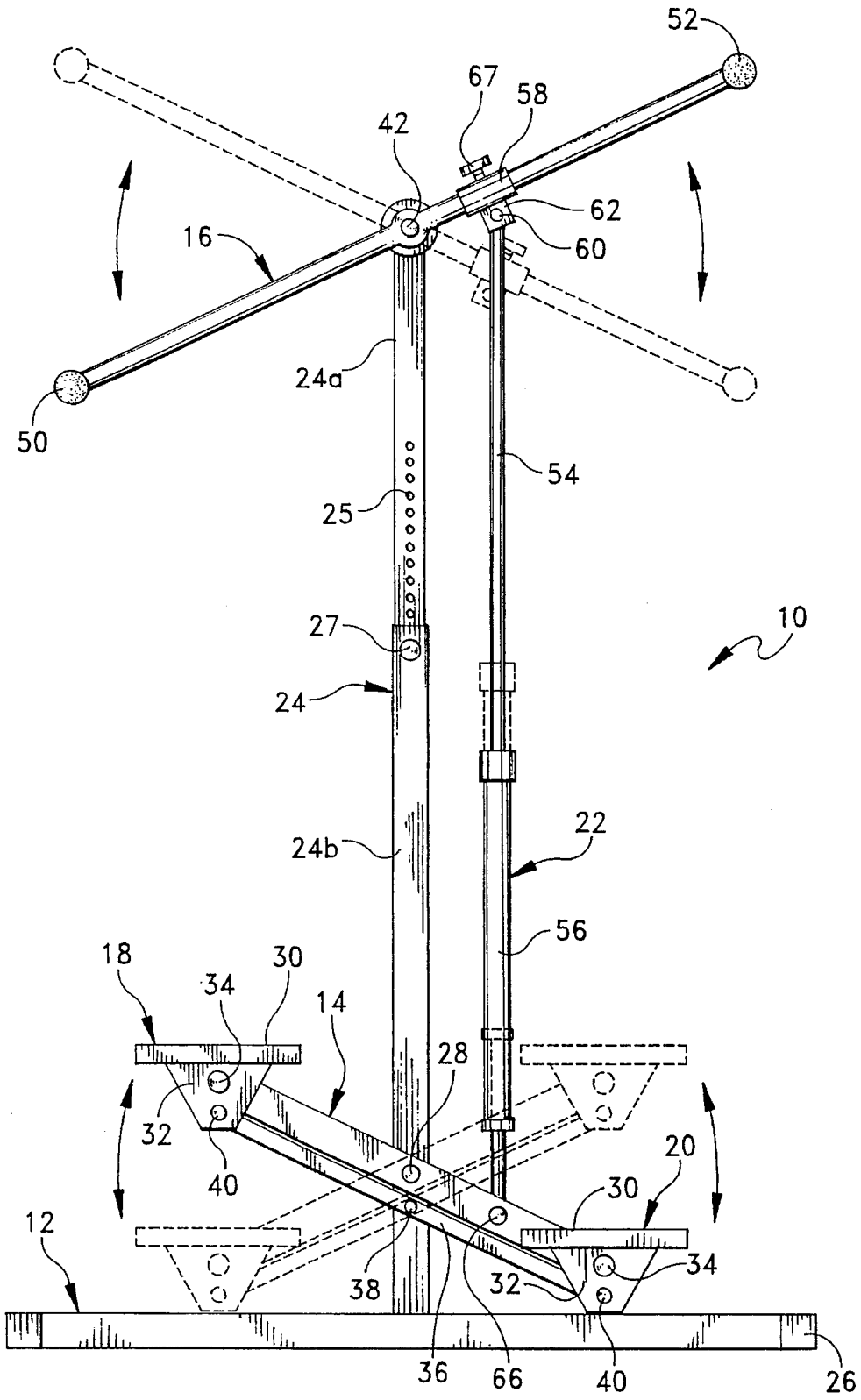
FIG. 2 is a front view thereof showing the foot platforms, resistance cylinder and upper pivot lever in reciprocated positions.
Figure 3:
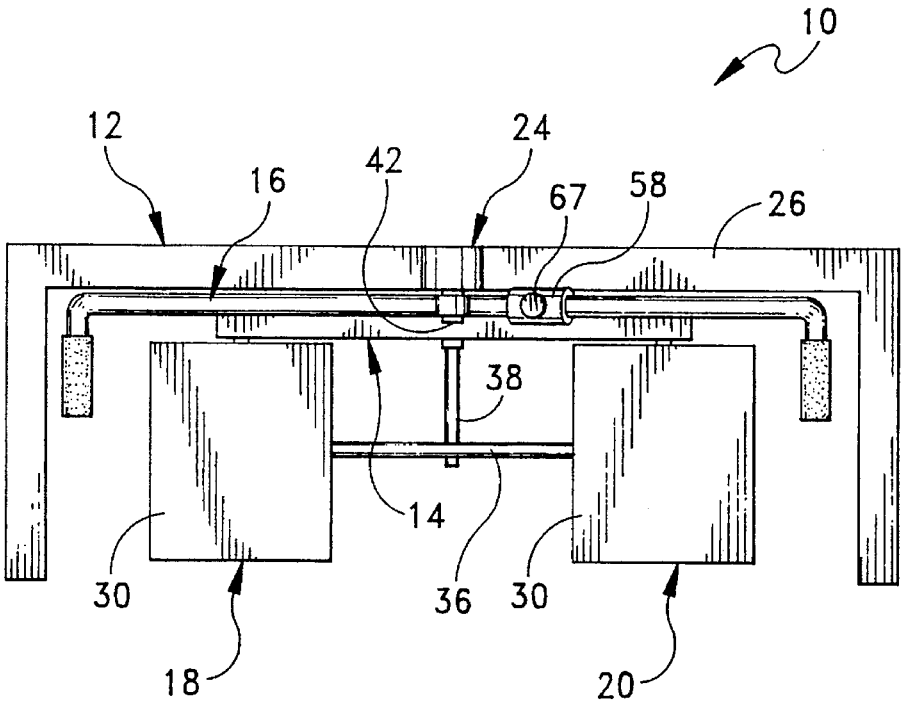
FIG. 3 is a top view thereof.
Figure 4:
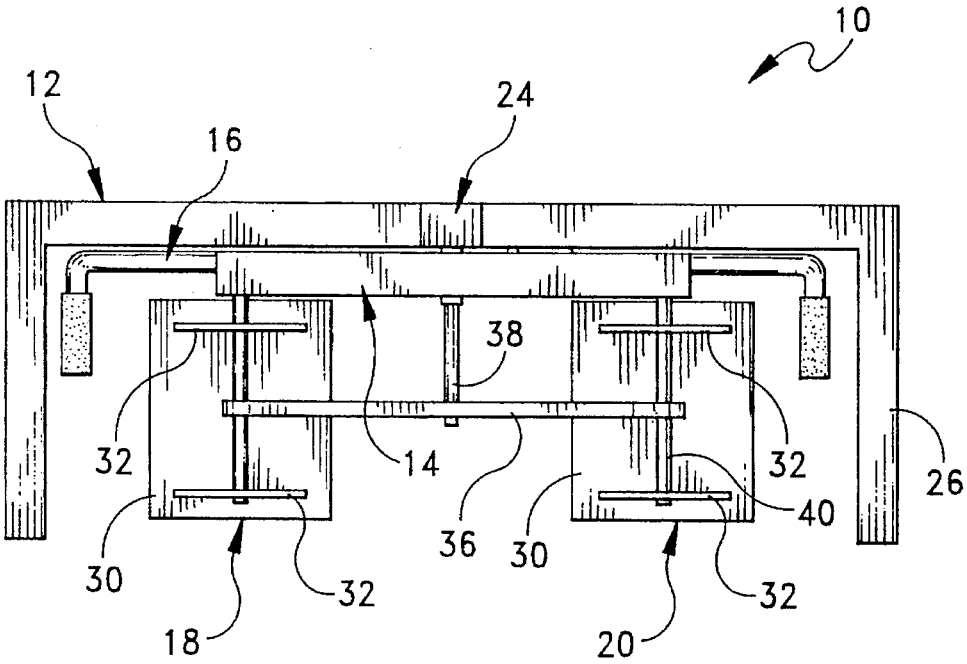
FIG. 4 is a bottom view thereof.

Referring now to the drawings, a first embodiment of an exercise device constructed in accordance with the teachings of the instant invention is illustrated and generally indicated at 10 in FIGS. 1–4. As will hereinafter be more fully described, the instant exercise device comprises a frame generally indicated at 12, first and second pivot levers generally indicated at 14, 16 respectively, first and second foot platforms generally indicated at 18, 20 respectively, and a resistance cylinder generally indicated at 22.

The frame 12 comprises an upright support member generally indicated 24, and a U-shaped base portion 26 for supporting the upright support member 24 on a supporting surface. The support member 24 includes upper and lower telescoping portions, **24*a* and 24*b* respectively. Upper telescoping portion 24*a* is slidably movable with respect to lower telescoping portion 24*b*, and is maintained in fixed position by means of a plurality of apertures 25 in upper telescoping portion 24*a*, and a spring biased pin 27 mounted to lower telescoping member 24*b*. The pin 27 is received in any one of the apertures 25 to adjust the vertical position of the upper pivot lever 16. The support member 24 and base 24 portion 26** are preferably constructed from tubular steel to provide sufficient rigidity to the structure.

The first, or lower, pivot lever 14 is pivotably mounted to the support member 24 at a first pivot axis adjacent the lower end of the support member 24. More specifically, the first pivot axis is defined by a pivot pin 28 which is received through an opening (not shown) in the center of the first pivot lever 14 and secured in an opening (not shown) in support member 24.

The foot platforms 18, 20 are identical in construction, each comprising a plate 30 having a flat upper stepping surface and a pair of flanges 32 extending downwardly from a lower surface thereof. Each flange 32 has a horizontally extending opening therein, wherein the openings are aligned for receipt of a pivot pin 34. The pivot pins 34 are secured in openings in the end portions of the first pivot lever 14 and extended through the aligned openings in the flanges 32 so that the platforms 18, 20 are pivotable with respect to the ends of the pivot lever 14.

The foot platforms 18, 20 are interconnected by a stabilizing bar 36 which is also pivotably mounted to the upright support member 24. A pivot pin 38 is extended through an opening in the stabilizing bar 36 and secured in an opening the support member 24. In this regard, the pivot axis of the stabilizing bar 36 is positioned below the pivot axis of the first pivot lever 14. The terminal ends of the stabilizing bar 36 are interconnected to the foot platforms 18, 20 by means of pivot pins 40 which extend through a second set of openings in the flanges 32, and through openings in the ends of the stabilizing bar 36. In use, the stabilizing bar 36 maintains the foot platforms 18, 20 in a substantially horizontal position when the first pivot lever 14 is reciprocated back and forth about its pivot axis.

The second, or upper, pivot lever 16 is pivotably mounted to the support member 24 at a second pivot axis which is located above the first pivot axis. The second pivot axis is defined by a pivot pin 42 which is received through an opening (not shown) in the center of the second pivot lever 16 and into a bearing assembly 44 mounted in the upper end of the support member 24. The first and second end portions 46, 48 respectively, of the upper pivot lever 16 are turned inwardly so as to be positioned above the foot platforms 18, 20. The inwardly turned ends 46, 48 are provided with resilient hand grip sleeves 50, 52 for grasping by the user.

The resistance cylinder 22 comprises a conventional hydraulic cylinder having a piston portion 54 which is pivotably connected to a first end portion of the second pivot lever 16, and a cylinder portion 56 which is connected to a first end portion of the first pivot lever 14. The cylinder 22 is preferably of a type that provides equal resistance in both directions. To secure the cylinder 22 to the device 10, a flange 58 is slidably received onto the upper pivot lever 16, and a pivot pin 60 provided on the upper end of the piston portion 54 is received through an opening in a downwardly extending portion 62 of the flange 58. The cylinder portion 56 includes a connecting rod 64 for attachment to the pivot lever 14. A pivot pin 66 is extended through an opening in the pivot lever 14 and through an aligned opening in the connecting rod 64 to form the pivot connection. In order to adjust the resistance level of the cylinder, the flange 58 is provided with a threaded screw 67 so that the flange 58 can be slidably moved along the length of the lever 16 and set in position. In this regard, movement of the flange 58 away from the central pivot 42 would increase the resistance provided by the cylinder 22, while movement toward the central pivot would decrease resistance.

In the alternative, the resistance cylinder 22 may comprise a cylinder which the resistance is controlled by an integral value. In this regard, the cylinder could be fixedly mounted to both the upper and lower pivot levers wherein resistance would then be controlled by adjusting the cylinder valve. Further more, if the valve cylinder were attached using the adjustable flange 58 as previously described, gross adjustment of the resistance could be provided by movement of the flange 58, while finite adjustments could be provided by the valve.

In use, the operator stands on top of the foot platforms 18, 20, grasps the hand grips 50, 52, and then rocks up and down on the platforms 18, 20 while pushing down and pulling up, on the hand grips 50, 52 to reciprocally move the first and second pivot levers 14, 16 back and forth about their respective pivot axes simulating a standing or pumping action on a bicycle. The resistance cylinder 22 provides a constant resistance to the reciprocal movement of the pivot levers 14, 16, while the stabilizer bar 36 maintains the foot platforms 18, 20 in a substantially horizontal position during the reciprocal movement of the foot platforms 18, 20. It is noted that the central support 24 is vertically adjustable so that the upper pivot lever 16 is positionable above the head of the user. In this configuration, the user would grasp the handles 52 above the head, pushing up and pulling down on the handles 52 to simulate a rock climbing action.

Figure 5:
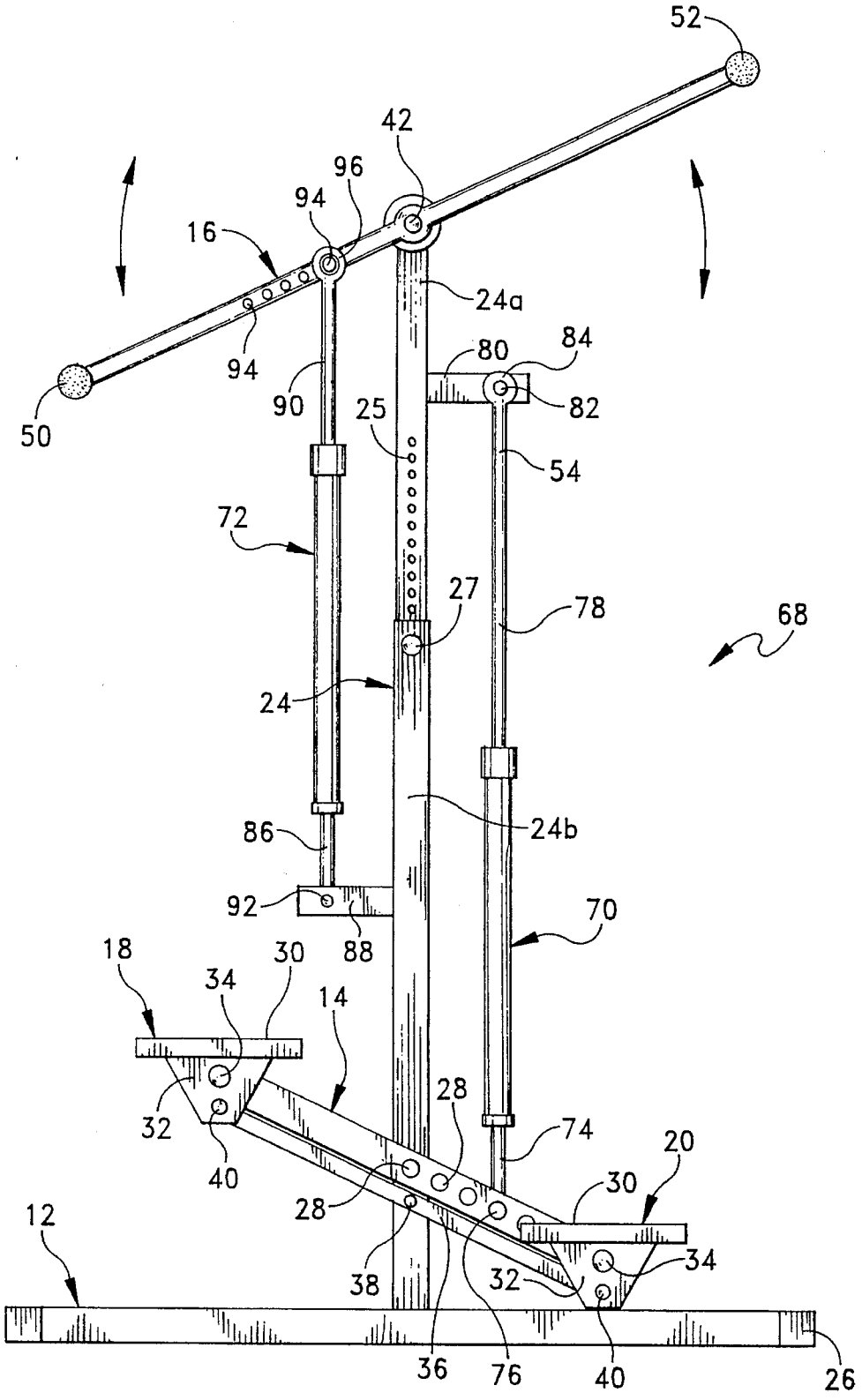
FIG. 5 is a front view of a second embodiment of the exercise device.

Referring now to FIG. 5, a second embodiment of the exercise device is generally indicated at 68. The device 68 differs from the first embodiment 10 in that the second device 68 is provided with separate first and second resistance cylinders 70, 72 respectively for independent adjustment of resistance on both upper and lower pivot levers 14, 16. This configuration allows exercise in either the diagonal, i.e. right foot down, right hand up, or on the parallel, i.e. right foot down right hand down. The first resistance cylinder 70 has a first end 74 pivotably mounted to the first pivot lever 14 by means of a pivot pin 76, and a second end 78 pivotably mounted to an arm 80 extending outwardly from the support member 24. A pivot pin 82 extends through both the arm 80 and a collar 84 on the end portion 78. The second resistance cylinder 72 has a first end 86 pivotably mounted to a second arm 88 extending outwardly from the support member, and a second end 90 pivotably mounted to the second pivot lever 16. A pivot pin 92 extends through the arm 88 and the first end 86, and another pivot pin 94 extends through a collar 96 on the second end and through the pivot lever 16. Adjustment of the resistance of cylinder 70 is accomplished by movement of pivot pin 76 to any one of a plurality of apertures 98 in the lower pivot lever 14. Similarly, adjustment of the resistance of cylinder 72 is accomplished by movement of collar 96 onto another of the pivot pins 94 longitudinally spaced along the upper pivot lever 16. In this manner, separate levels of resistance can be achieved for the upper and lower pivot levers 14, 16. It is to be understood that cylinders 70, 72 may also comprise value controlled hydraulic cylinders which may be fixedly mounted to the pivot levers at both ends, thereof or which may be attached as described previously.

Figure 6:
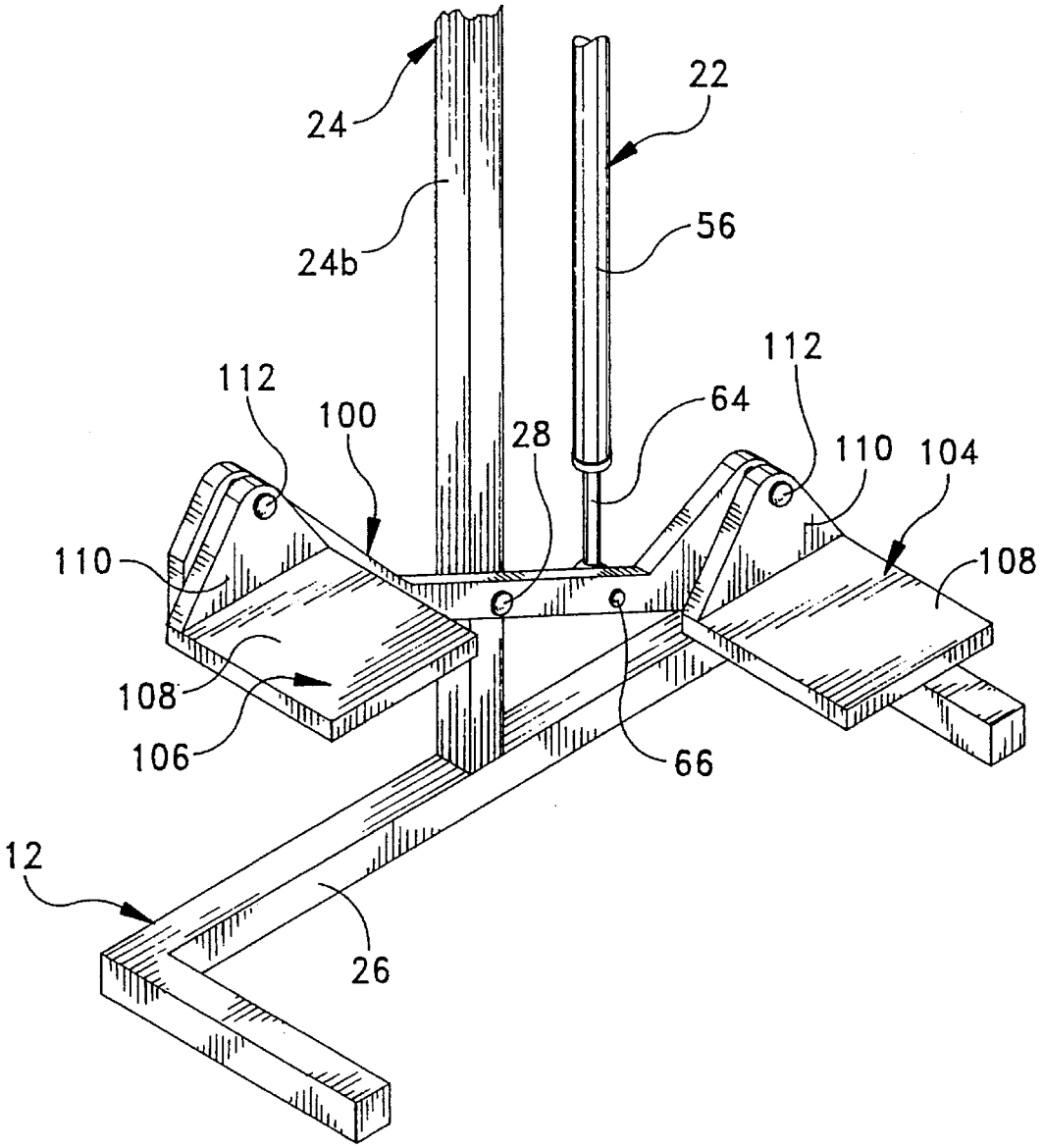
FIG. 6 is a perspective view of an alternate form of the lower pivot lever, which is effective for use in either of the illustrated embodiments.

Referring now to FIG. 6, an alternative construction of the lower pivot lever is illustrated and generally indicated at 100. The base 12, including the upright support 24 and U-shaped base 26 are the same as previously described. The pivot lever 100 is pivotably mounted to the support member by a pivot pin 102 secured to the support member 24. The assembly further includes two foot platforms 104, 106 which are identical in construction. Each of the platforms 104, 106 includes a horizontal plate 108 and vertical flange 110 at one end. The flange 110 is pivotably connected to the pivot lever 100 by a pivot pin 112 aligned along a longitudinal centerline of the platform. Central placement of the pivot pin 112 enables the foot platforms 104, 106 to naturally seek a horizontal orientation when weight is placed on top thereof. This configuration effectively eliminates the need for a lower stabilizing bar as illustrated in the earlier embodiments, and in this regard this configuration is fully interchangeable with the lower pivot configurations as previously described.

It can therefore be seen that instant invention provides a unique and effective exercise device which simulates bicycling, rock climbing and climbing action movement. Reciprocal movement of the interconnected upper and lower pivot levers 14, 16 provides an effective upper and lower body workout in a single device. Furthermore, by maintaining one of the upper or lower pivot levers in stationary position, the user can independently operate the other lever for an isolated upper or lower body workout. The instant devices are simple in form and function, simple to operate, and extremely stable during use. In particular, the upper pivot mechanism provides a stable hand hold for the operator during use, thereby allowing a more comfortable and better overall workout than the prior art devices. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

We claim:

1. An exercise device comprising:

a frame including an upright support member;

a first pivot lever pivotably mounted at a first pivot axis on said support member, said pivot lever including first and second end portions;

first and second foot platforms respectively pivotably mounted on the first and second end portions of said first pivot lever;

a second pivot lever pivotably. mounted at a second pivot axis on said support member, said second pivot axis being positioned above said first pivot axis, said second pivot lever including first and second end portions; and resistance means connected between a first end portion of said first pivot lever and a first end portion of said second pivot lever, wherein resistance is provided during reciprocating movement of said first and second pivot levers.

2. The exercise device of claim 1, further comprising hand grip means on each of the first and second end portions of said second pivot lever.

3. In the exercise device of claim 1, said resistance means comprising a hydraulic resistance cylinder.

4. The exercise device of claim 3, further comprising means for adjusting a resistance level of said hydraulic cylinder.

5. In the exercise device of claim 1, said upright support member being vertically adjustable to adjust the vertical height of the second pivot lever with respect to the first pivot lever.

* * * * *